United States Patent [19]

McArthur et al.

[11] Patent Number: 4,819,282

[45] Date of Patent: Apr. 11, 1989

[54] TILTING MECHANISM FOR USE WITH INFANT BASSINETTE

[75] Inventors: James McArthur, Coquitlam; Herbert W. Bentz, Vancouver, both of

[73] Assignee: Med-Ex Diagnostics of Canada Inc., Coquitlam, Canada

[21] Appl. No.: 129,811

[22] Filed: Dec. 7, 1987

[51] Int. Cl.[4] ..... A61G 7/00

[52] U.S. Cl. ..... 5/62; 5/509

[58] Field of Search ..... 5/62, 74 R, 74 B, 75, 5/77, 509, 61, 432, 433; 108/8, 9; 248/371, 396, 397

[56] References Cited

U.S. PATENT DOCUMENTS 4,715,073 12/1987 Butler ..... 5/62

4,734,945 4/1988 Wright ..... 5/75 X

FOREIGN PATENT DOCUMENTS 1160606 7/1958 France ..... 108/9

2419068 11/1979 France ..... 5/62

*Primary Examiner*—Gary L. Smith

*Assistant Examiner*—Michael F. Trettel

*Attorney, Agent, or Firm*—Townsend & Townsend

[57] ABSTRACT

This invention discloses a two-way tilting mechanism for use with infant bassinettes. It is comprised of a pivotable support adapted to receive an infant bassinette, a base upon which the support is pivotably mounted, a single-action pivoting mechanism connecting the support to the base, locking means for holding the support in a tilted position, and means for releasing the locking means.

8 Claims, 2 Drawing Sheets

TILTING MECHANISM FOR USE WITH INFANT BASSINETTE

FIELD OF THE INVENTION

This invention relates generally to infant bassinettes but, more particularly, to a tilting mechanism for use therewith.

DESCRIPTION OF THE PRIOR ART

Infant bassinettes are used in neo-natal care centres, nurseries, delivery rooms and special birthing units. These are often accompanied by mobile infant intensive care systems used in warming, lighting, resuscitation and fatal therapy treatment of infants. Infant bassinettes are usually designed to eliminate unnecessary disturbances of infants, when the treatment team is working close to the infant and when x-rays are to be taken of the infant. In addition, a bassinette is usually designed with a mechanism adapted to tilt the bassinette for the Trendelenburg Fowler positions.

The problem associated with prior art design is that the bed tilting mechanism was difficult to adjust smoothly and quietly to reduce the risk of motion-induced trauma to the infant.

In addition, the bassinette size has to be limited when used with a mobile care system since little room is available to permit the tilting of the bassinette to the aforementioned positions.

SUMMARY OF THE INVENTION

It is therefore the object of the present invention to provide a tilting mechanism for use with infant bassinettes in which the mechanism is smooth, quiet and easy to use.

Another object of the present invention is to provide a tilting mechanism for use with infant bassinettes which allows the use of a larger-sized bassinette while still permitting the tilting of the bassinette to various positions without being restricted by the mobile intensive care system design.

Accordingly, an aspect of the present invention is to provide a two-way tilting mechanism for use with infant bassinettes, comprising:

a pivotable support adapted to receive an infant bassinette;

a base above which said support is pivotally mounted;

a single-action pivoting mechanism connecting said support to said base;

locking means for holding said support in a tilted position; and means for releasing said locking means.

DESCRIPTION OF THE DRAWINGS

Particular embodiments of the invention will be understood in conjunction with the accompanying drawings in which.

DESCRIPTION OF THE PREFERRED EMBODIMENTS

Figure 1:
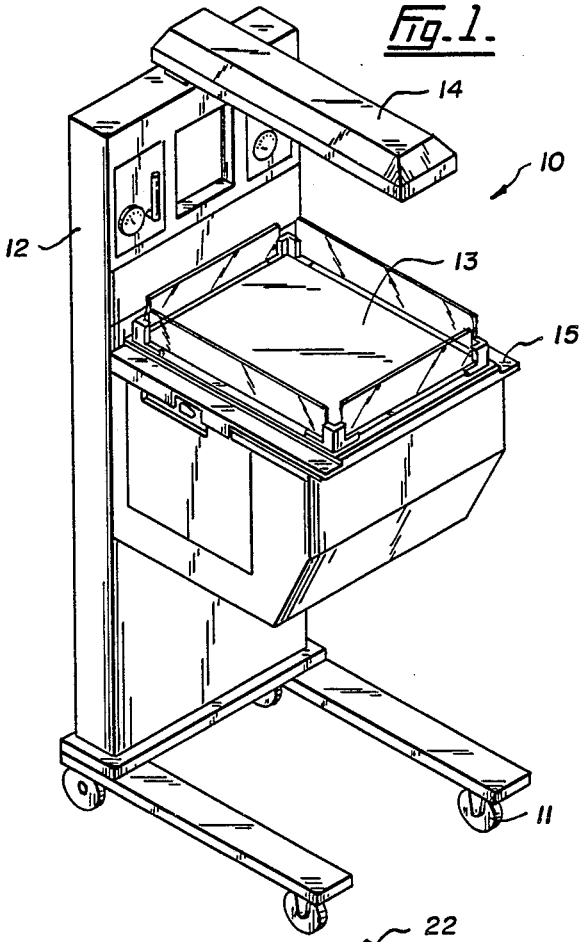
FIG. 1 is a general perspective view of a mobile infant intensive care system for use with the present invention.

Referring now to FIG. 1, we have shown an isometric view at reference 10 of a mobile infant care unit used in the first crucial moments following birth, when the newborn's heart, lungs and blood status must be observed and monitored. The infant care unit is usually provided with casters 11 providing the care unit with its mobility. It includes a control panel 12 adapted to monitor the condition of the infant. The infant is placed on a procedure table and mattress 13 and is kept warm by a warmer/lighting module 14. The procedure table and mattress 13 is placed over a base 15 which includes a tilting mechanism adapted to tilt the table for the Trendelenburg/Fowler positions.

Figure 2:
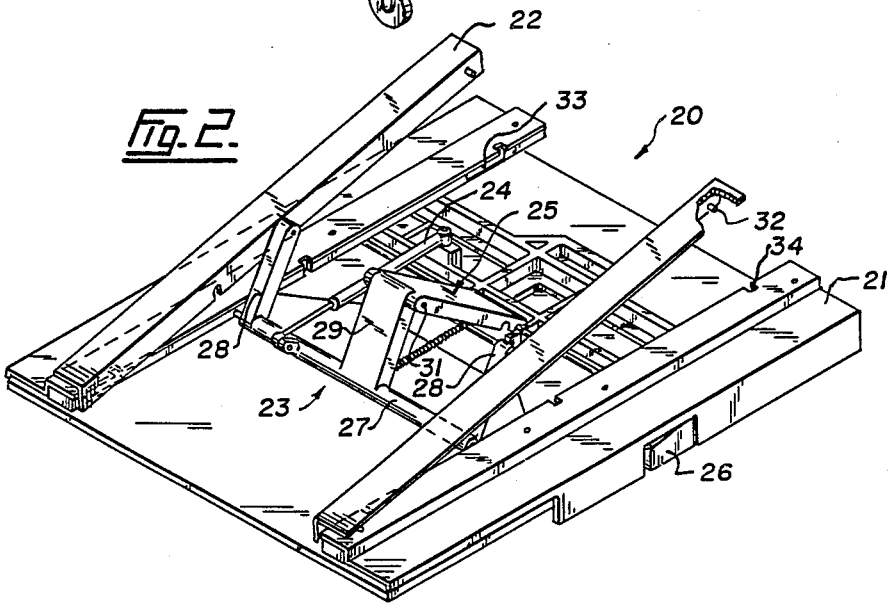
FIG. 2 is a perspective view of the tilting mechanism of the present invention shown in the tilted position.

Referring now to FIG. 2, we have shown at reference 20 an isometric view of the tilting mechanism used in the present invention.

The tilting mechanism of the present invention is basically provided with a base 21, a pivotable support 22 pivotally mounted to support 21 by means of a single-action pivoting mechanism 23. Also included is a damping piston 24 used to smooth out the raising and lowering of support 22 and locking means 25 adapted to secure the pivoting mechanism. An actuating lever 26 is provided on a side edge of base 21 to permit deactivation of locking means 25.

Figure 3:
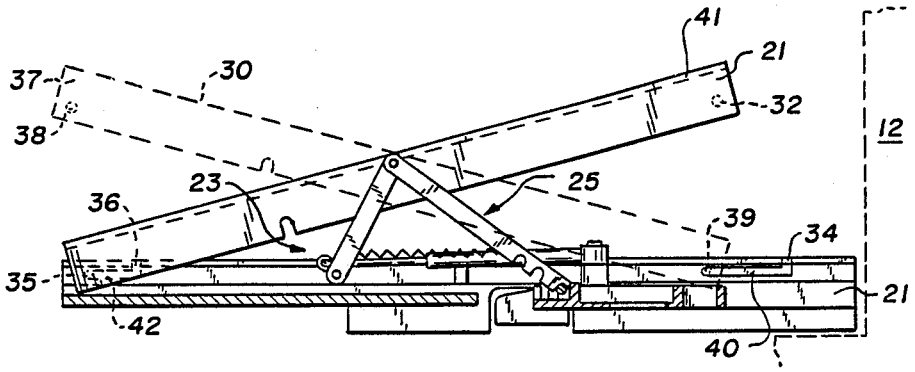
FIG. 3 is a side view thereof.

As can be seen in FIG. 3, the pivoting mechanism 23 will allow, through a single action, the tilting of support 22 from one direction to another depicted by phantom lines 30.

Referring again to FIG. 2, the pivoting mechanism is comprised of a main pivot rod 27, having a pair of projecting arms 28 and 28' which act as pivoting actuators and to which is connected support 22. Centrally located on main pivot rod 27 is a third projecting member 29. It is used for actuating locking means 25. Projecting member 29 is pivotally connected to locking means 25 by means of a pin 31.

As seen at the partially-sectioned end of pivotable support 22, a laterally-extending pin or position limiter 32 is used to control the direction of tilt of pivotable support 22. A pin 32, is provided at each end of each arm of support 22. Each pin is adapted to be received into a channel 33 on each side of base 21. A slot, as shown at reference 34, is provided above each channel and allows entry of pin 32 into the channel.

Referring again to FIG. 3, the pivoting mechanism is so designed such that support 22 will move away from control panel 12 when tilted in either direction.

In addition, pin 32 and 35 at each end of a support arm are so disposed such that when a support arm is lying on base 21, each pin will be directly beneath slots 34 and 36 of base 21. These will permit the tilting of support 22 in either direction by lifting the respective end. For example, to position support 22 in the position shown at reference numbered 30, free end 37 will be lifted upwardly to free pin 38 from slot 36. Simultaneously, pin 39, at the opposite end, will travel along channel 40 to stop at a desired location determined by locking means 25.

Similarly, to position support arm 22 to the position shown in FIG. 3, end 41 is lifted upwardly so that pin 32 clears slot 34. At the opposite end, pin 35 will travel along slot 42 to a position determined by locking means 25.

As can be seen, the tilting mechanism 23 will pivot in the same direction whether support arm 22 is tilted in the direction shown by the solid line or by phantom line 30.

Figure 4:
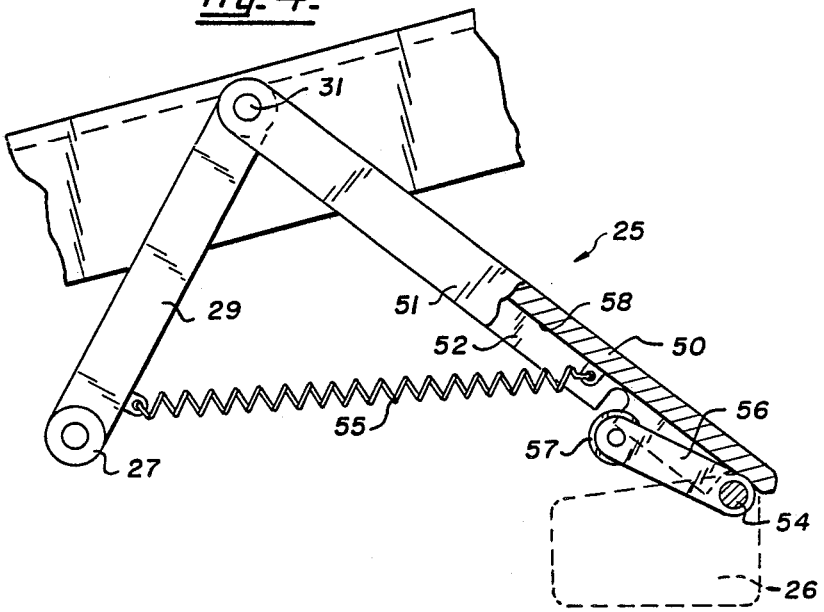
FIG. 4 is a partially-sectioned side view of the tilting mechanism's locking means used with the present invention.

Referring now to FIG. 4, we have shown a partially-sectioned side view of locking means 25. Locking means 25 is comprised of a locking lever 50 rotatably-mounted to actuating lever 29 by means of pin 31. Lever 50 is provided with downwardly-extending edges 51 and 52, each having a series of slots 53 adapted to secure the support arms in a number of tilted positions. Slots 53 are adapted to engage with a laterally-extending rod 54 parallel to main pivot rod 27. The cross-sectional diameter of rod 54 is, of course, smaller than the width of slot 53.

Locking means 25 is adapted to automatically secure the support arms in a pre-determined position. This is achieved by means of a tension spring 55 connected between projecting arm 29 and locking lever 50. Actuating lever 26 is fixedly secured to rod 54 and release member 56 is adapted to rotate therewith. At the opposite end of release member 56 is provided a wheel or ring 57 rotatably mounted thereon. Wheel 57 will rotate against the interior surface 58 of locking lever 50 when actuating lever 26 is rotated clockwise.

As lever 26 is rotated clockwise, wheel 57 will rest against surface 58 to raise locking lever 50, thereby disengaging slot 53 from rod 54. Accordingly, the support arms can be pivoted downwardly to lie horizontal and parallel to base 21.

We claim:

1. A two-way tilting mechanism for use with infant bassinettes, comprising:

a pivotable support adapted to receive an infant bassinet;

a base upon which said pivotable support is pivotally mounted;

a pivoting mechanism connecting said pivotable support to said base comprising a pivotable actuating member having first and second pivotal axes, said first axis being pivotally connected to said base, and said second axis being pivotally connected to said pivotable support along a line intermediate the ends of said pivotable support to define an axis about which said support is tiltable;

locking means extending from said second axis of said pivoting mechanism for holding said support in a tilted position; and means for releasing said locking means.

2. A tilting mechanism, as defined in claim 1, further comprising guiding means on said base adapted to guide said support when pivoted from a horizontal plane to a tilted plane.

3. A tilting mechanism, as defined in claim 2, wherein said pivotable support is formed with a pin at each corner, and said guiding means comprises a series of channels for slidable engagement of said pins thereby limiting the movement of said pivotable support about said intermediate axis.

4. A tilting mechanism, as defined in claim 1, wherein said locking means comprises a locking lever pivotally mounted to said pivoting mechanism at said second axis, said locking lever having a free end with a plurality of slots, each of said slots adapted to engage a rotatable rod extending across said base.

5. A tilting mechanism, as defined in claim 4, wherein said means for releasing said locking means comprises a release member connected to said rod and adapted to rotate therewith such that, when rotated upwardly, said free end of said locking lever will lift upwardly to disengage said slot from about said rod.

6. A tilting mechanism, as defined in claim 4, including resilient biasing means extending between said locking lever and said pivotable actuating member.

7. A tilting mechanism, as defined in claim 1, including damping means extending between said base and said pivotable actuating member to damp the motion of said tilting mechanism.

8. A tilting mechanism, as defined in claim 7, wherein said damping means is a hydraulic cylinder.

* * * * *